United States Patent [19]

Santoni

[11] 3,949,877

[45] Apr. 13, 1976

[54] NESTABLE DRUM

[75] Inventor: Cesar Santoni, Hamilton, Canada

[73] Assignee: Greif Bros. Corporation, Delaware, Ohio

[22] Filed: Mar. 4, 1974

[21] Appl. No.: 447,733

[52] U.S. Cl. ..... 206/519; 206/508; 220/72

[51] Int. Cl.[2] ..... B65D 21/02

[58] Field of Search ..... 206/503, 508, 515, 518, 206/519, 520; 220/72, DIG. 22

[56] References Cited

UNITED STATES PATENTS

| | | | |
|---|---|---|---|
| 112,477 | 3/1874 | Merrill | 206/519 |
| 1,331,372 | 2/1920 | Popper | 220/DIG. 22 |
| 1,351,900 | 9/1920 | Freundt | 206/519 |
| 1,770,163 | 7/1930 | McCrery | 206/508 |
| 2,114,137 | 4/1938 | Conner | 206/503 |
| 2,205,685 | 6/1940 | Conner | 220/72 |
| 2,239,093 | 4/1941 | Giller | 206/519 |
| 3,168,222 | 2/1965 | Wander | 206/520 |
| 3,187,934 | 6/1965 | Huber | 220/72 |
| 3,205,677 | 9/1965 | Stoner | 206/519 |
| 3,272,671 | 9/1966 | Gaylord | 206/508 |
| 3,353,707 | 11/1967 | Eyler | 229/1.5 B |
| 3,425,382 | 2/1969 | Johnson | 113/120 R |
| 3,653,581 | 4/1972 | Ptak | 206/518 |

*Primary Examiner*—George E. Lowrance
*Attorney, Agent, or Firm*—Kane, Dalsimer, Kane, Sullivan and Kurucz

[57] ABSTRACT

A nestable drum is provided with a tubular shell having a lower section and a top section of increased diameter joined by an integral step located approximately at the shell middle. The larger diameter top section is adapted to conveniently receive the reduced bottom section to facilitate nesting when drums are stacked one upon the other. The step is formed with a series of spaced reinforcing gussets which are adapted to rest on the top end of a lower drum in the stack. The top of the shell is necked-in and possesses a diameter less than that of the top section and is curled outwardly to provide a bead which receives a cover locked in place by a split clamping ring. One form of cover is provided with an indentation which is adapted to receive the bottom closure of a stacked drum to lock it in place and thereby prevent any relative sliding.

6 Claims, 5 Drawing Figures

NESTABLE DRUM

BACKGROUND OF THE INVENTION

Metals particularly steel are becoming increasingly unavailable and when obtained are generally priced at a sufficiently high level to dramatically affect the ultimate costing structure of the product being produced. This is indeed the case with steel drums.

Another factor affecting the cost of such drums is the inherent disadvantage of large space requirements for their shipping and storage particularly while in an empty condition because they are obviously generally large and bulky and cannot be collapsed.

SUMMARY OF THE INVENTION

The foregoing disadvantages are effectively overcome by the present invention which permits space saving through nestability of the contemplated metallic drums and for a given drum capacity requires less metal with consequent material savings.

Another object is to provide a drum of several different diameters from a single metallic sheet for the body or shell portion with consequent variation in the metal gauge accompanying the different diameter sections.

A further object is to provide a drum of the foregoing type with the diameters of either the top or bottom end being either the same or increased or decreased within permissible limits; and within such a drum construction the present invention permits the combination of: a necked-in style cover; a standard cover; or a necked-in bottom.

Still another object is to provide a drum that is capable of being stacked when filled as well as when empty in order that the stacked drums will be interlocked to prevent sliding or slippage, thereby providing for ease in handling, safety in storage, as well as security from external movement particularly during transportion.

An important object is to incorporate in the drum of the foregoing type anti-vacuum locking provisions which also serve the purpose of reducing and minimizing undue scuffing of the exterior paint and/or interior coating.

Other objects and advantages will become apparent from the following detailed description which is to be taken in conjunction with the accompanying drawings.

DETAILED DESCRIPTION OF THE PREFERRED EMBODIMENT

Figure 1:
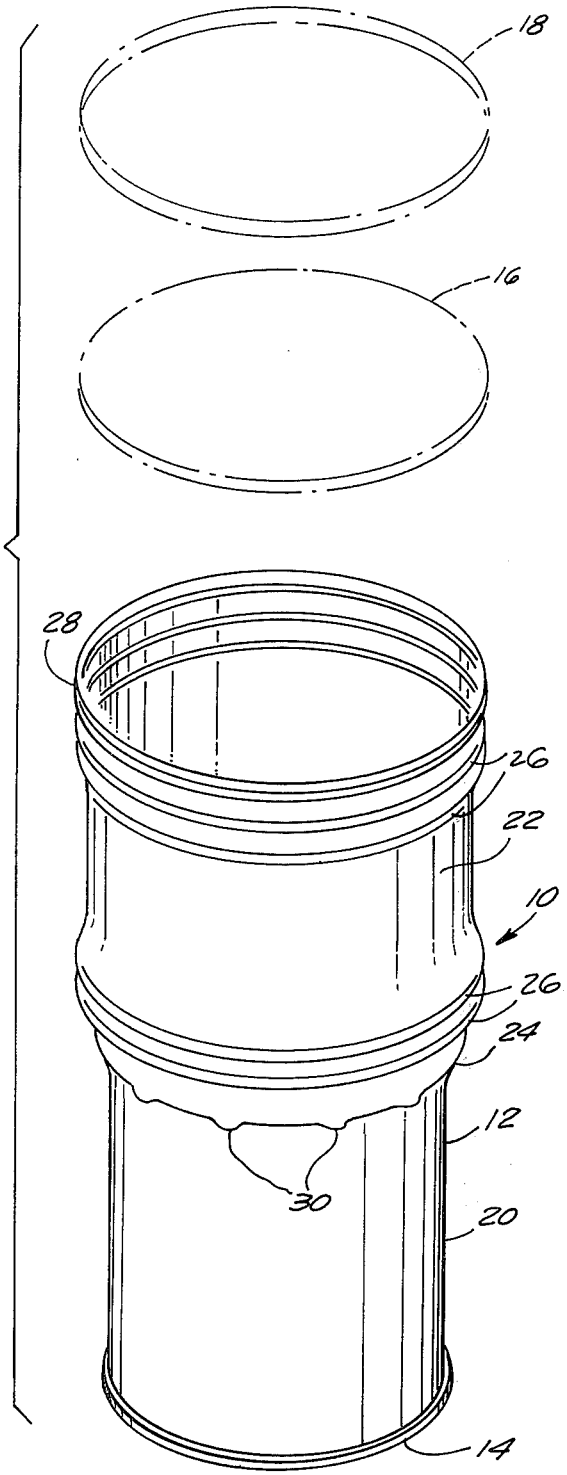
FIG. 1 is a perspective view of a drum incorporating the teachings of this invention shown associated with a cover and split clamping ring by way of phantom representation.
Figure 2:
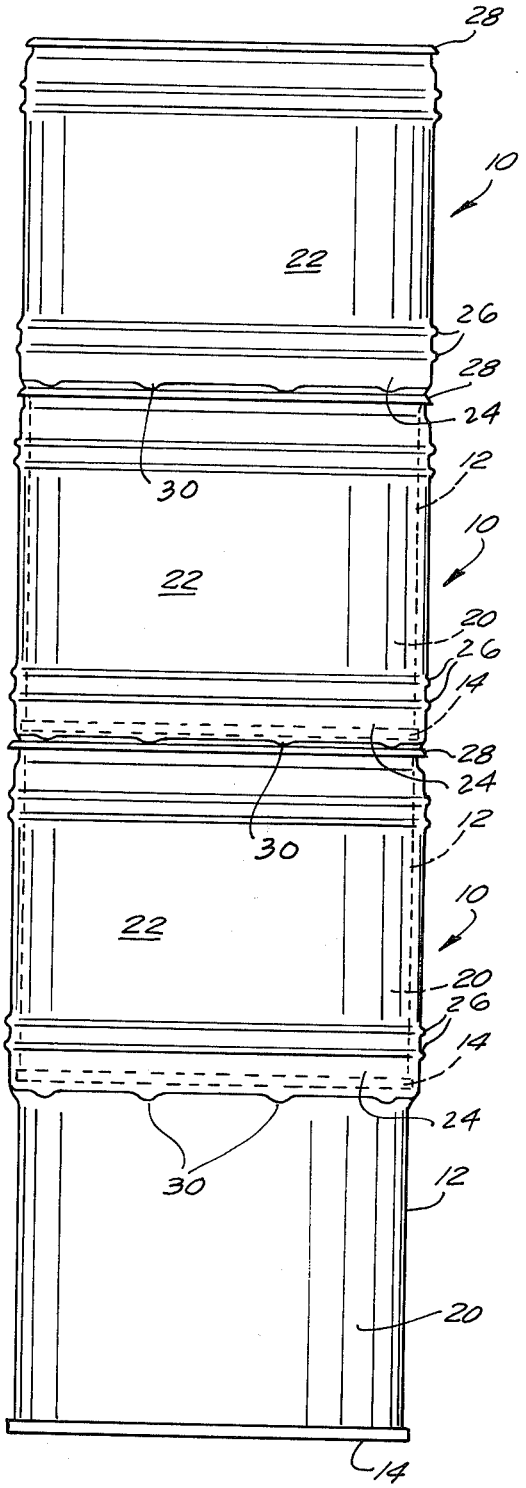
FIG. 2 is a side elevational view of three empty drums shown in a nesting relationship with the drums stacked one upon the other.
Figure 3:
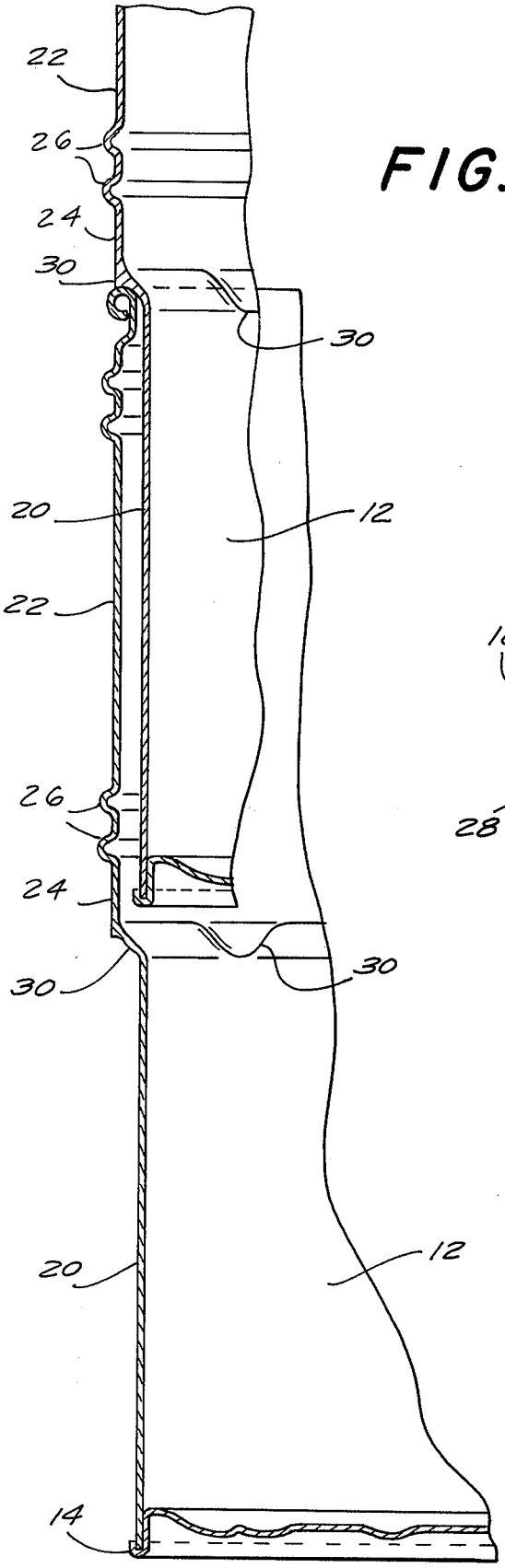
FIG. 3 is an enlarged fragmentary sectional view showing the relationship of parts and interengagement of surfaces of nested empty drums.

The drum 10 of the instant invention is provided with a multi-diameter body or shell 12 and one of any number of bottom closures 14 and top closures 16 the latter which may also include a split clamping ring 18. In the exemplary embodiment the shell 12 will include a bottom tubular section 20 and an enlarged or expanded top tubular section 22 and an integral intermediate step 24. One or more corrugations, ribs or body rolling hoops 26 may be provided at set intervals. The integral rolling hoops at the top of the drum permits the body to take the type of shocks which are likely to dislodge the cover 16. This closure 16 may be fully removable and may be part of the illustrated necked-in type of end construction. In this form of construction the curl or bead 28 often called "false-wire" is smaller in diameter than the body of top section 22 of the drum. The purpose of this particular construction is to protect the container closure and particularly the closure ring 18 to prevent dislodgement of the cover should the drum be subjected to rough handling or abuse when in storage or transit after filling.

In view of the difference in diameter between top section 22 and bottom section 20 the empty drums may be stacked by nesting the bottom section 20 of one drum into the interior of the top section 22 of a lower drum. When empty drums are nested each inside of the other in this fashion, either for storage or shipping (without the covers installed) the top of the lower drum supports the bottom section of the upper drum in such a fashion to be securely held or locked both vertically and horizontally in a given tier of drums for ease in handling, safety in storage, as well as giving extra security for external movement during transportation. Towards this end, the steps 24 are provided with a series of protuberances 30 which in addition to furnishing additional rigidity and body reinforcement at this juncture permits the peripheral exterior side wall of each drum in the nest to be supported thereby. The protuberance 30 will rest on and are in contact with the top bead or falsewire 28 of the next lower placed drum in a nest. This arrangement prevents undue scuffing of the exterior paint and/or interior coating, which might otherwise occur if the entire surfaces of the inner and outer drum were in normal direct contact when nested. An additional attribute of the protuberances 30 is to prevent each inner drum that is tightly nested in the top section 20 of the lower drum to be otherwise air or vacuum locked together which would make extraction difficult when tiers are being un-nested.

Figure 4:
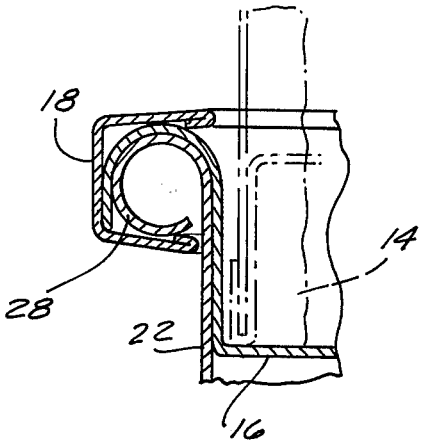
FIG. 4 is an enlarged fragmentary section view of the top end of the drum having a cover and clamping ring associated therewith with the bottom end of another filled container shown stacked thereon and locked against lateral sliding movement.

As exemplified by FIG. 4 filled drums 10 may be conveniently stacked one upon the other for storage or shipment. The bottom of the upper drum will lock into the intended cover 16 of the lower drum. In this manner sliding is prevented and an additional safety factor is provided in handling for both storage and shipping purposes.

The present invention contemplates the manufacture of drums with circular containers in two, three, or four different diameters in a single metal sheet body section, in various gauges, after the metal body has been joined by seam welding on standard manufacturing equipment. In actual practice the diameters at either the top or bottom end of a particular drum body can be either the same, or can be increased or decreased to the extent of an inch and a half or more. This differential permits the accommodation in the same drum body of: a necked-in style (reduced diameter) cover, or a standard cover (i.e., where the cover and bottom are the same diameter); or a necked-in bottom (i.e., where the bottom is smaller than the cover diameter).

It has been found that seven empty drums constructed in accordance with the present invention as shown in the figures of 55 gallon capacity, will occupy the very same space and have the cubical dimensions of four standard drums or ordinary drums of the same capacity. Likewise, eleven of the drums of this application will occupy the same cubic volume as six standard drums-again saving in space more than 45 percent in both storage and shipping. Translating this aspect of the present invention into a significant solution to the ever increasing costs of transportation indicates that the capacity of an empty drum warehouse can be increased to the extent shown. Furthermore, if 345 standard drums can be accommodated in a given space, 500 drums of the present application of the same capacity can be enclosed in the same space. This space accommodation is the equivalent of a railway car. Turning now to the economy in material usage and the manufacture of the drums of the present invention reference will be made to a specific successful embodiment of the invention. This drum had an exterior height of 36 inches, a bottom end diameter of 21 inches, a head or cover diameter of 21½ inches, a bottom half diameter drum body of 21 inches, a top half diameter drum body of 22 inches, a capacity of 55 gallons and a necked-in top end construction and fully removable head with locking ring of the type illustrated in the several figures. In order to produce a drum or other circular container with this capacity, in any gauge, by normal manufacturing methods would require (for the 22 inch diameter portion) a metal sheet 69⅛ inches in length (allowing for ⅜ inch seam lap for joint seam welding) times 38 inches or 38¾ inches in width (depending upon the depth and number of corrugations or rolling hoops) or in other words an approximate minimum of 2,679 square inches of metal. The drum of the present invention in any capacity that is desired, with a previously mentioned variation amounting up to 1½ inches anywhere on the drum, permits the use of a metal sheet of the circumferential dimensions required to encompass the smallest diameter in any given diameter in a circular body formation. As is consequence, the 21 inch bottom diameter becomes the dimensional diameter of the metal sheet used in producing the drum shown in the figures. To fabricate a circular drum body out of steel in the same capacity referred to above requires the use of 2,572 square inches of metal. Deducting this figure from the 2,679 square inches of metal sheet normally required for the 22 inch diameter container to be manufactured produces a net savings of 107 square inches of metal amounting to approximately 4 percent in body metal. Assuming 24 gauge metal is used, a minimum savings of seven cents per drum body sheet at the current cost of cold rolled steel is experienced. The use of heavier gauge metal would result in greater proportionate savings per drum.

As will be apparent to those skilled in the art the drum style of the present invention permits the accommodation of several of the available top and bottom closure constructions.

In accordance with the successful applications of the present invention, metal ranging in gauges 18 through 26 was employed, but there would be no restriction on the use of heavier or lighter gauge metal. The end diameter range of drums is from 10 inches to 24 inches, height 42 inches, and in capacities 10 to 85 gallons. These drums were designed and constructed for transporting dry products of any type, particularly for Metal Products, Greases, Flake Caustic, and other Chemicals.

Figure 5:
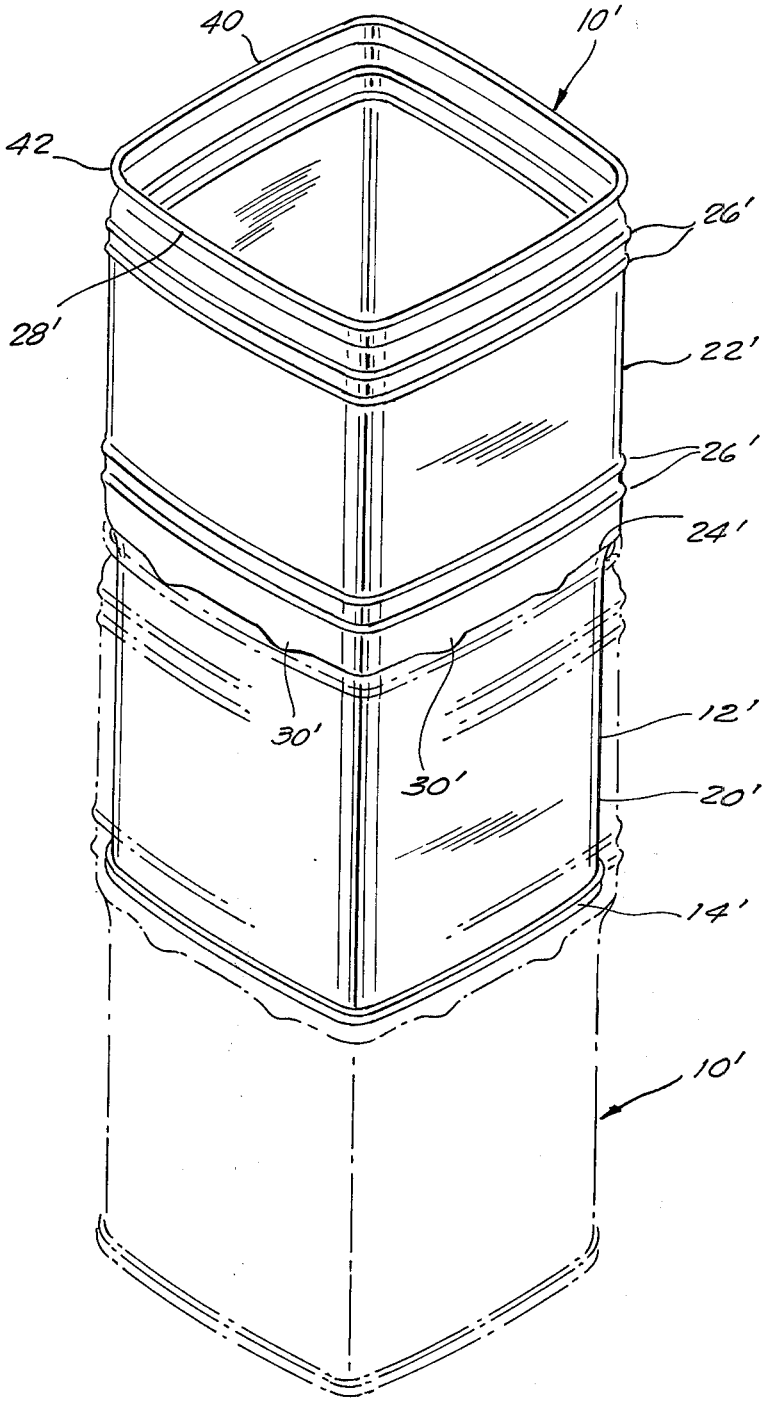
FIG. 5 is a perspective view of another embodiment of drum approaching a square cross-section throughout its length.

In FIG. 5 like parts will be similarly numbered with an accompanying prime. The embodiment illustrated in this figure depicts one of several other cross-sectional configurations which the drum of this invention may adopt. Towards this end, the drum 10' possesses transversely convex sides 40 joined together by rounded corners 42. A drum of this type would further improve the space saving qualities most advantageously attained by the present invention. In all other respects the drum of this embodiment resembles that of the previously described and illustrated embodiment.

Thus the several aforenoted objects and advantages are most effectively attained. Although several somewhat preferred embodiments of the invention has been disclosed and described in detail and it should be understood that this invention is in no sense limited thereby and its scope is to be determined by that of the appended claims.

I claim:

1. A large nestable drum of multi-gallon capacity and capable of containing heavy leads with space saving capabilities comprising in combination:

a high strength large metal tubular shell, the tubular shell being formed with a welded seam and having a bottom end and a top end, and further being divided into a bottom substantially vertical sided tubular section having a top and bottom and a top substantially vertical sided tubular section having a top and bottom and the major portion of which having essentially the same radius of curvature from its top to its bottom the top section and the bottom section being interconnected by an integral circumferential step intermediate the shell ends and extending substantially at a continuous uniform axial point about the circumference of the shell, the top section possessing a larger cross-section than the bottom section, the larger top section being initially formed with the same gauge material as the bottom section and being expanded to the larger cross-section and becoming thinner than the bottom section to provide a larger size drum without the necessity of additional material, the bottom section being adapted to be received by and nest in the open top section of another of such drums when stacked one above the other, the step including anti-locking means for preventing the stacked drums from being air locked together;

the anti-locking means being defined by a series of spaced outwardly extending reinforcing gussets forming an integral part of the step, the gussets being formed of outwardly and downwardly projecting substantially arcuate protuberances spaced about the circumference of the drum and when the bottom section of one drum being nested in the open top section of another of such drums the protuberances of the upper drum resting on the top end of the lower drum to provide only a predetermined number of point contacts with the top end of a lower drum thereby providing minimum surface contact and engagement with the lower drum so as to reduce scuffing of surface of the stacked drums; and a closure at the bottom end.

2. The invention in accordance with claim 1, wherein the top end is necked in and possesses a smaller cross-section than the top section for protecting the inwardly extending top end and thereby preventing dislargement of a cover placed over the top end when subject to rough handling and abuse during shipment and storage.

3. The invention in accordance with claim 1, wherein the top end is formed into a top body outwardly extending curl defining an outer peripherally extending bead.

4. The invention in accordance with claim 1, wherein the top end is formed into a top body outwardly extending curl defining an outer peripherally extending bead, a cover having a peripherally extending identation over the top end surfaces of the bottom closure of a stacked drum adapted to extend into the indentation of cover to lock the stacked drums and prevent lateral sliding.

5. The invention in accordance with claim 1, wherein the drum is circular in cross-section throughout its length, and a plurality of body rolling hoops are formed integrally as part of the top section.

6. The invention in accordance with claim 1, wherein the drum and cross-section includes transversely convex sides joined together by rounded corners, and a plurality of body rolling hoops are formed integrally as part of the top section.

* * * * *

UNITED STATES PATENT OFFICE

CERTIFICATE OF CORRECTION

PATENT NO. : 3,949,877

DATED : April 13, 1976

INVENTOR(S) : Cesar Santoni

It is certified that error appears in the above-identified patent and that said Letters Patent are hereby corrected as shown below:

Column 4, line 27, "leads" should be -- loads --.

Signed and Sealed this

Thirteenth Day of July 1976

[SEAL]

*Attest:*

RUTH C. MASON
*Attesting Officer*

C. MARSHALL DANN
*Commissioner of Patents and Trademarks*